US008960668B2

(12) United States Patent
Obuchi

(10) Patent No.: US 8,960,668 B2
(45) Date of Patent: Feb. 24, 2015

(54) SHEET-DISCHARGE APPARATUS, SHEET PROCESSING APPARATUS, AND IMAGE FORMING APPARATUS

(75) Inventor: Yusuke Obuchi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 13/267,168

(22) Filed: Oct. 6, 2011

(65) Prior Publication Data

US 2012/0093555 A1 Apr. 19, 2012

(30) Foreign Application Priority Data

Oct. 14, 2010 (JP) ..... 2010-231499
Sep. 27, 2011 (JP) ..... 2011-210275

(51) Int. Cl.

*B65H 31/00* (2006.01)
*G03G 15/00* (2006.01)
*B65H 29/14* (2006.01)
*B65H 29/24* (2006.01)

(52) U.S. Cl.

CPC ..... *G03G 15/6552* (2013.01); *B65H 29/14* (2013.01); *B65H 29/245* (2013.01); *B65H 2405/11151* (2013.01); *B65H 2515/112* (2013.01); *B65H 2515/212* (2013.01); *B65H 2801/06* (2013.01); *G03G 2221/1645* (2013.01)

USPC ..... 271/211; 271/209; 271/195

(58) Field of Classification Search

USPC ..... 271/207, 209, 211, 194, 195
See application file for complete search history.

(56) References Cited

U.S. PATENT DOCUMENTS 3,334,895 A * 8/1967 Daniels et al. ..... 271/211
3,502,407 A * 3/1970 Ellis et al. ..... 399/335
4,811,547 A * 3/1989 Raats et al. ..... 53/284.4
5,460,361 A * 10/1995 Mokler ..... 271/183
6,522,841 B2 * 2/2003 Horikoshi ..... 399/45
6,826,374 B2 11/2004 Kato et al.
6,904,261 B2 6/2005 Fujii et al.
6,997,449 B2 2/2006 Obuchi et al.
7,017,491 B2 * 3/2006 Edamitsu ..... 101/477
7,547,015 B2 * 6/2009 Lee et al. ..... 271/213
8,682,240 B2 * 3/2014 Fukita et al. ..... 399/405
2009/0256308 A1 * 10/2009 Kazama et al. ..... 271/226
2010/0329726 A1 * 12/2010 Kasuga ..... 399/92

FOREIGN PATENT DOCUMENTS

JP 63171764 A * 7/1988 ..... B65H 31/34
JP 2000153948 A 6/2000
JP 2010-132372 6/2010
JP 2010132372 A 6/2010

* cited by examiner

*Primary Examiner* — Prasad Gokhale
(74) *Attorney, Agent, or Firm* — Fitzpatrick, Cella, Harper & Scinto

(57) ABSTRACT

The sheet processing apparatus includes a sheet-discharge fan that blows air downward of a sheet-discharged by an upper sheet-discharge roller, and a control portion configured to control an air velocity of air blown from the sheet-discharge fan according to a basis weight of the sheet. In the case where the basis weight of the sheet is a predetermined value or less, the control portion increases the air velocity of the sheet-discharge fan according to the basis weight of the sheet based on basis weight information from an input portion for inputting the basis weight information of the sheet. The control portion also controls the air velocity of the sheet-discharge fan to be a velocity at which the sheet whose rear edge contacts the sheet-stacking wall does not move in a sheet-discharge direction in the case where the basis weight of the sheet exceeds the predetermined value.

21 Claims, 11 Drawing Sheets

SHEET-DISCHARGE APPARATUS, SHEET PROCESSING APPARATUS, AND IMAGE FORMING APPARATUS

BACKGROUND OF THE INVENTION

1. Field of the Invention

The present invention relates to a sheet-discharge apparatus, a sheet processing apparatus, and an image forming apparatus, and more particularly to apparatuses that can discharge a sheet to a sheet-stacking portion while blowing air on a lower surface of the sheet to be discharged, thereby preventing a reduction in sheet alignment properties without reducing productivity.

2. Description of the Related Art

Conventionally, image forming apparatuses such as copiers, laser beam printers, facsimiles, and combination units thereof include a sheet-discharge apparatus that discharges a sheet on which an image is formed onto a stacking tray. Sheet processing apparatuses that process a sheet on which an image is formed also include a sheet-discharge apparatus that discharges a processed sheet onto a stacking tray.

If a leading edge of a sheet that is a downstream edge in a sheet-discharge direction hangs down when the sheet is discharged, the leading edge may be brought into contact with a stacking tray and be rounded, thereby reducing alignment properties. In order to prevent such a reduction in alignment properties, various techniques are proposed for conventional sheet-discharge apparatuses.

For example, in Japanese Patent Application Laid-Open No. 2010-132372, air is blown on a lower surface of a sheet to be discharged to increase sheet alignment properties. FIG. 11 illustrates a sheet-discharge operation of such a conventional sheet-discharge apparatus. A sheet P on which an image is formed is discharged from a sheet-discharge roller 12*b*, and stacked on a sheet-discharge tray 91. At this time, a leading edge P1 of the sheet P is away from the sheet-discharge roller 12*b* and thus hangs down to a state shown by a broken line in the drawing. However, even in such a case, a lower fan 32 blows air toward the sheet-discharge tray 91 to prevent the leading edge P1 from hanging down.

When the sheet P is discharged from the sheet-discharge roller 12*b*, the lower fan 32 stops, and an upper fan 31 placed above the sheet-discharge tray 91 blows air. Thus, a trailing edge P2 (upstream edge) of the sheet P is brought into contact with a reference wall 91*a*, and then the sheet P falls onto the sheet-discharge tray 91 while being guided by the reference wall 91*a*, thereby allowing the sheet P to be stacked with alignment properties.

In the conventional sheet-discharge apparatus having such a configuration, a sheet is sometimes discharged with a trailing edge as an upstream edge in a sheet-discharge direction being curved upward. In this case, when a sheet to be stacked is a sheet with a low basis weight that is a mass per unit area (1 $m^2$), that is, a sheet with low stiffness, a discharged sheet is stacked while fitting a stacking tray, or a stacked sheet having already been discharged and stacked on the stacking tray.

However, when the sheet is a sheet with a predetermined basis weight or more, that is, a sheet with a predetermined stiffness or more, a discharged sheet is discharged and stacked without fitting the stacking tray or a stacked sheet on the stacking tray. In this case, air blown from a fan presses a trailing edge of the sheet, thereby reducing sheet alignment properties on the stacking tray. Alternatively, air blown from the fan may raise the trailing edge of the sheet to close a sheet-discharge outlet.

SUMMARY OF THE INVENTION

In view of such circumstances, a purpose of the present invention is to provide a sheet-discharge apparatus, a sheet processing apparatus, and an image forming apparatus that can prevent a reduction in sheet alignment properties without reducing productivity.

Another object of the present invention is to provide a sheet-discharge apparatus including: a sheet-discharge portion that discharges a sheet; a sheet-stacking portion that is inclined so that a downstream side in a sheet-discharge direction is higher and on which the sheet-discharged by the sheet-discharge portion is stacked; a contact portion that is provided upstream in the sheet-discharge direction of the sheet-stacking portion, and with which an upstream edge in the sheet-discharge direction of the discharged sheet is brought into contact by an inclination of the sheet-stacking portion to regulate a position of the upstream edge in the sheet-discharge direction; an air blow unit that blows air downward of the sheet discharged by the sheet-discharge portion from an air blow outlet provided between the sheet-discharge portion and the sheet-stacking portion; and a control portion configured to control an air velocity of air blown from the air blow unit, so as to increase an air velocity of the air blow unit with increasing basis weight of the sheet when the basis weight of the sheet is a predetermined value or less, and to set the air velocity of the air blow unit to a minimum air velocity of the air blown for the sheet discharge when the basis weight of the sheet exceeds the predetermined value.

A further purpose of the present invention is to control the air velocity of the air blow unit that blows air downward of the sheet depending on the basis weight of the sheet, thereby preventing a reduction in sheet alignment properties without reducing productivity.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
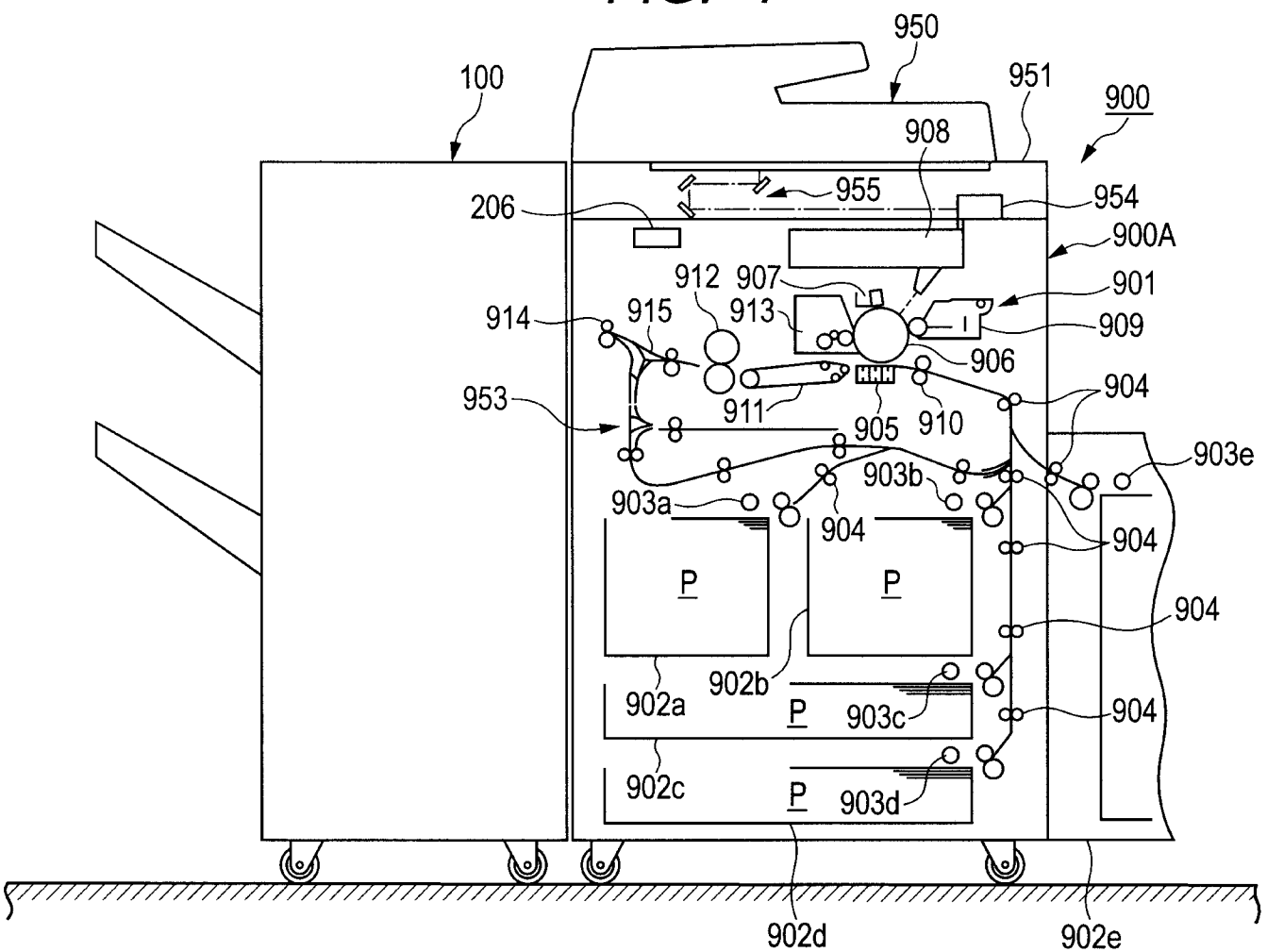
FIG. 1 illustrates a configuration of an image forming apparatus including a sheet processing apparatus having a sheet-discharge apparatus according to an embodiment of the present invention.

Now, an embodiment for carrying out the present invention will be described in detail with reference to the drawings. FIG. 1 illustrates a configuration of an image forming apparatus including a sheet processing apparatus having a sheet-discharge apparatus according to the embodiment of the present invention. In FIG. 1, reference numeral 900 denotes an image forming apparatus, and 900A denotes an image forming apparatus body (hereinafter referred to as an apparatus body). The apparatus body 900A includes an image reader (image reading apparatus) 951 including a scanner unit 955 and an image sensor 954, an image forming portion 901 that forms an image on a sheet, and a double-sided apparatus 953, or the like. On an upper surface of the apparatus body 900A, a document feeding apparatus 950 is provided that feeds a document to an unshown platen glass.

The image forming portion 901 includes a cylindrical photoreceptor drum 906, a charger 907, a developer 909, a cleaning apparatus 913, or the like, and a fixing apparatus 912, a pair of discharge rollers 914, or the like are further provided downstream of the image forming portion 901. To the apparatus body 900A, a finisher 100 is connected that is a sheet processing apparatus that processes a sheet on which an image has been formed and discharged from the apparatus body 900A. Reference numeral 206 denotes a CPU circuit portion that is a control portion that controls the apparatus body 900A and the finisher 100.

Next, an image forming operation of the apparatus body 900A having such a configuration will be described. When an image forming signal is output from the CPU circuit portion 206, the document feeding apparatus 950 first places a document on a platen glass, an image of the document is read by the image reader 951, and read digital data is input to an exposure portion 908. The exposure portion 908 applies light depending on the digital data to the photoreceptor drum 906. At this time, a surface of the photoreceptor drum 906 is uniformly charged by the charger 907, and when the light is thus applied, an electrostatic latent image is formed on the surface of the photoreceptor drum. The electrostatic latent image is developed by the developer 909, and thus a toner image is formed on the surface of the photoreceptor drum.

On the other hand, when a sheet feeding signal is output from the CPU circuit portion 206, a sheet P set in cassettes 902*a* to 902*d* and a sheet feeding deck 902*e* is first conveyed to a registration roller 910 by sheet feeding rollers 903*a* to 903*e* and a pair of conveying rollers 904. Next, the sheet P is conveyed to a transfer portion including a transfer charger 905 at such timing that a leading edge of the sheet and a leading edge of the toner image on the photoreceptor drum are aligned by the registration roller 910. In the transfer portion, a transfer bias is applied to the sheet P by the transfer charger 905, and thus the toner image on the photoreceptor drum is transferred to the sheet.

Then, the sheet P to which the toner image is transferred is conveyed to the fixing apparatus 912 by a conveyor belt 911, and the toner image is thermally fixed when the sheet P passes through the fixing apparatus 912. At this time, foreign matters such as residual toner adhering to the photoreceptor drum without being transferred to the sheet P is scraped off by the cleaning apparatus 913. This clears the surface of the photoreceptor drum 906, preparing for next image forming.

Next, the sheet on which the toner image is thermally fixed by the fixing apparatus 912 is conveyed as it is to the finisher 100 by the pair of rollers 914. When images are formed on opposite sides of the sheet P, the sheet P on which the toner image is thermally fixed is then conveyed to the double-sided apparatus 953 by a switching member 915, a surface on which an image is to be formed is reversed, and then the sheet P is again fed to the image forming portion 901, and an image is formed on a back surface. Then, the sheet P is conveyed to the finisher 100 by the pair of discharge rollers 914.

Figure 2:
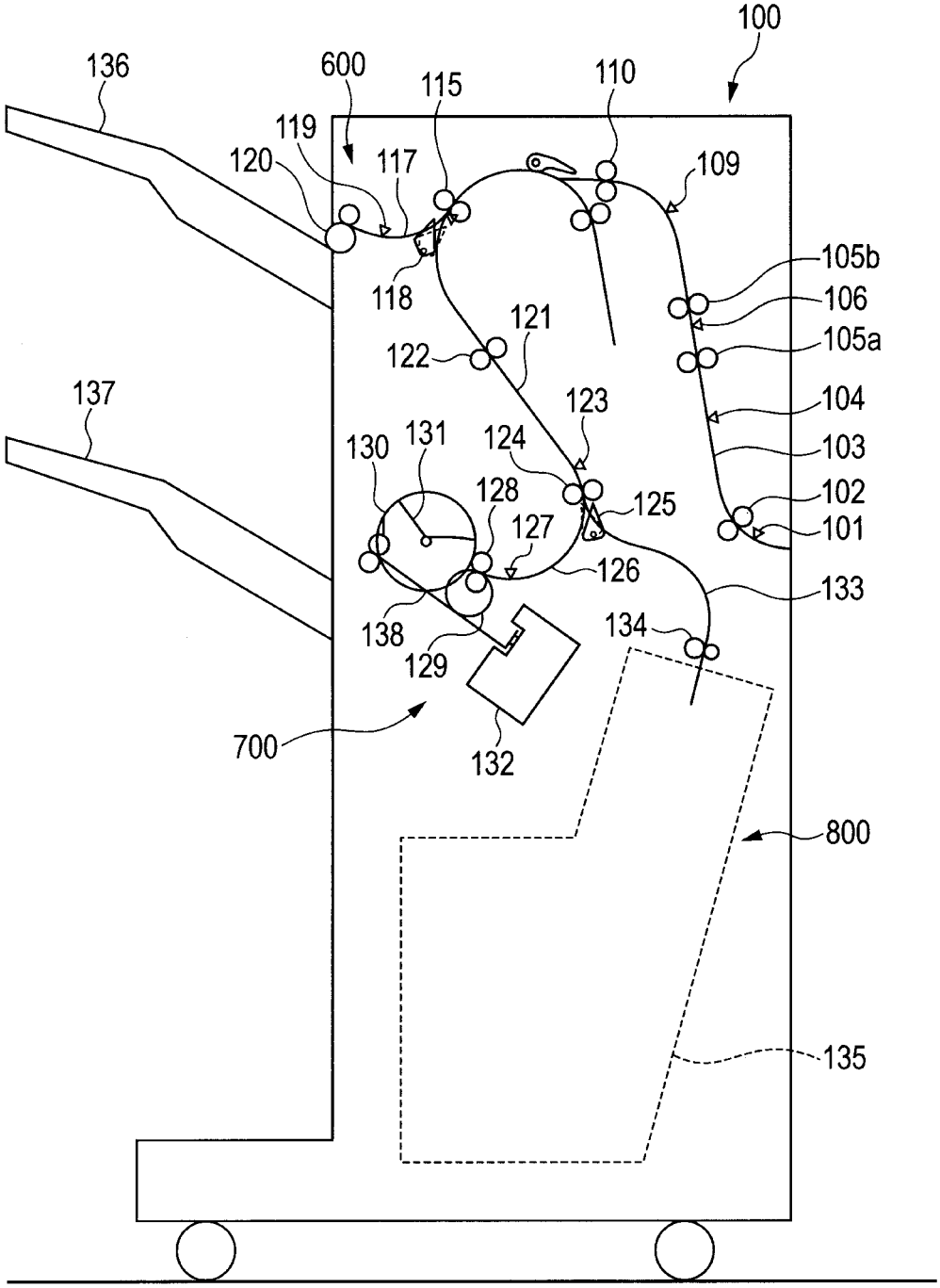
FIG. 2 illustrates a configuration of a finisher provided in the image forming apparatus.

The finisher 100 successively takes in sheets discharged from the apparatus body 900A, aligns and bundles up the plurality of taken sheets, and punches a hole near a trailing edge of the taken sheet using an unshown punching portion. The finisher 100 also staples the bundle of sheets, and binds the sheets and the like, and includes, as shown in FIG. 2, a stapling portion 700 that staples the sheets and a saddle stitching binding portion 800 that folds the bundle of sheets double and binds the sheets.

The finisher 100 includes a pair of inlet rollers 102 that take the sheet into the apparatus, and the sheet-discharged from the apparatus body 900A is fed to the pair of inlet rollers 102. At this time, an inlet sensor 101 simultaneously detects feeding timing of the sheet.

Then, the sheet conveyed by the pair of inlet rollers 102 passes through a conveying path 103, a sheet end position is detected by a lateral direction registration detection sensor 104, and a degree of displacement in a width direction from a center position of the finisher 100 is detected. After the displacement in the width direction (hereinafter referred to as a lateral direction registration error) is detected, an unshown shift unit is moved a predetermined distance toward a front or a back while the sheet is conveyed by a pair of shift rollers 105*a* and 105*b*, thereby performing a shift operation of the sheet.

Figure 5:
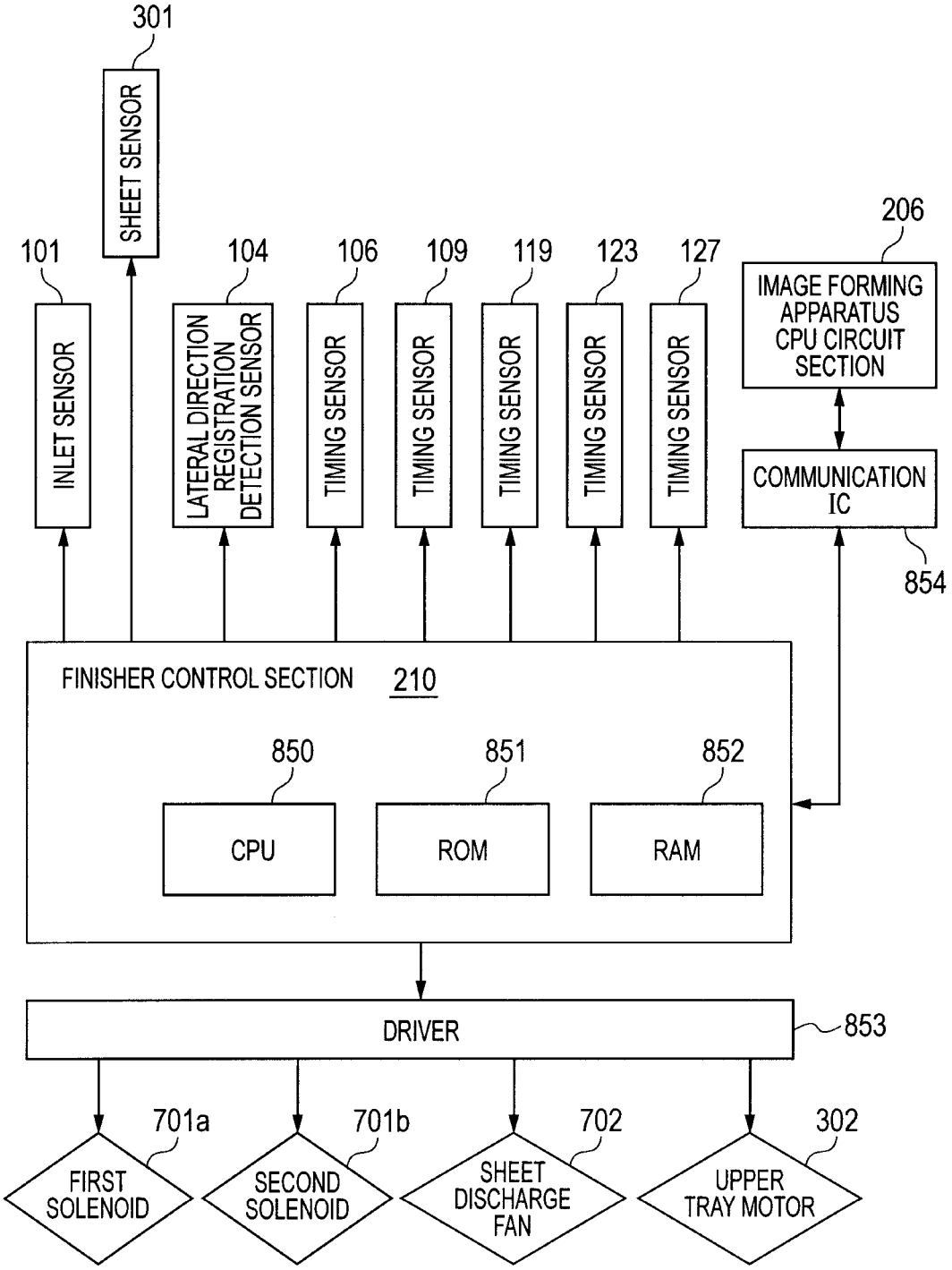
FIG. 5 is a control block diagram of a finisher control portion that controls the finisher.

Then, the sheet is conveyed by a pair of conveying rollers 110, and reaches a pair of buffer rollers 115. Then, when the sheet is discharged to an upper tray 136, an upper path switching means 118 enters a state shown by a broken line in the drawing by a first solenoid 701 as shown in FIG. 5 described later. Thus, the sheet is guided by an upper path conveying line 117 and discharged to the upper tray 136 by an upper sheet-discharge roller 120 provided in the sheet-discharge apparatus 600. The sheet-discharged to the upper tray 136 does not require stapling in an intermediate processing tray 138 as described later, and the punched sheet or the like described above is also discharged to the upper tray 136 when stapling is not required.

When the sheet is not discharged to the upper tray 136, the sheet conveyed by the pair of buffer rollers 115 is guided to a bundle conveying path 121 by the upper path switching member 118 in a state as shown by a solid line, and then the sheet successively passes through the conveying path by a conveying roller 122 and a pair of bundle conveying rollers 124. Then, when the conveyed sheet is discharged to a stacking tray 137 on a lower side, the sheet is first conveyed to a lower path 126 by a saddle path switching member 125 in a state shown by a solid line, and then discharged to the intermediate processing tray 138 by a pair of lower sheet-discharge rollers 128.

The discharged sheets are successively stacked and aligned by a returning member such as a paddle 131 or a belt roller 129, and thus a predetermined number of sheets are aligned and processed on the intermediate processing tray as a sheet-stacking portion where a bundle of sheets aligned and stacked is processed. Then, the bundle of sheets thus aligned and processed on the intermediate processing tray is stapled by a stapler 132 as required, and then discharged to the stacking tray 137 on the lower side by the pair of bundle discharge rollers 130.

On the other hand, when the sheet is saddled (saddle stitching), the saddle path switching member 125 is moved to a position shown by a broken line by a second solenoid 701*b* shown in FIG. 5 described later. Thus, the sheet is conveyed to the saddle path 133, and guided to a saddle stitching binding portion 800 by a pair of saddle inlet rollers 134.

Figure 3A:
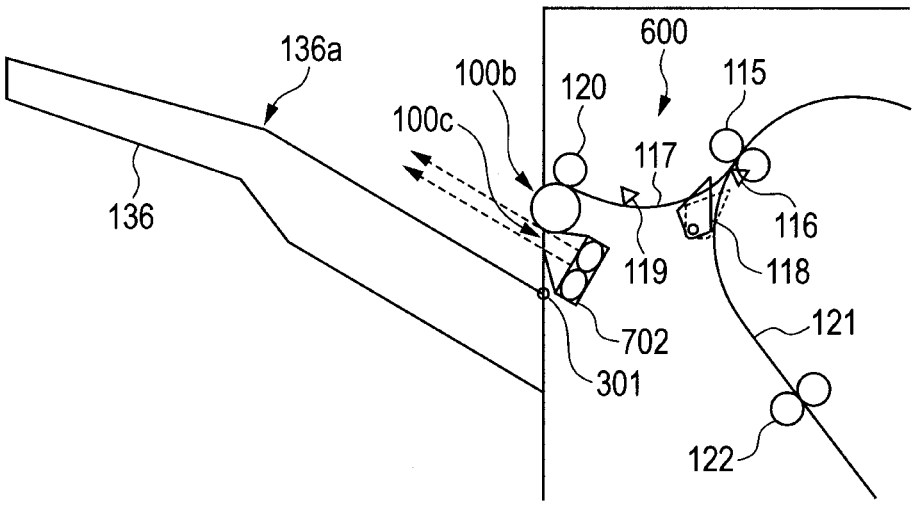
FIG. 3A illustrates a configuration of the sheet-discharge apparatus provided in the finisher.
Figure 3B:
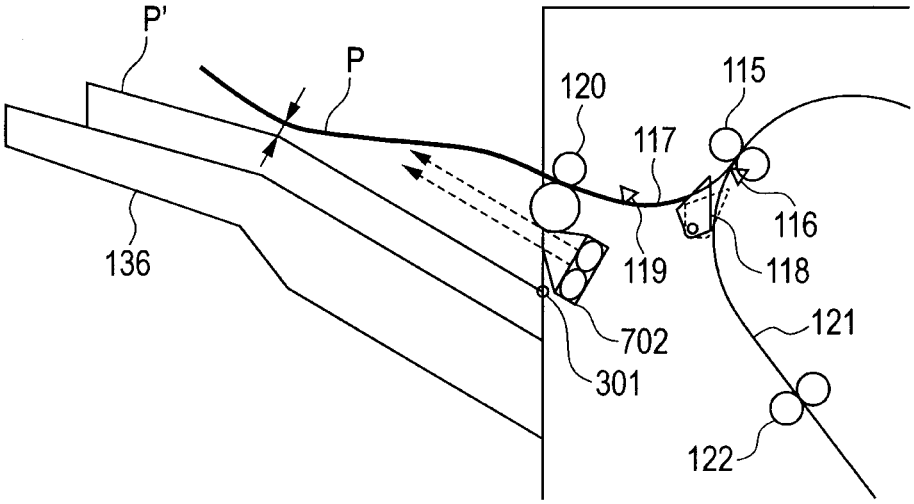
FIG. 3B illustrates a first state of a sheet in a sheet-discharge operation of the sheet-discharge apparatus provided in the finisher.

The sheet-discharge apparatus 600 includes, as shown in FIGS. 3A and 3B, an upper sheet-discharge roller 120 that is a sheet-discharge portion, and the upper tray 136 that is a sheet-stacking portion that is inclined so that a downstream side in a sheet-discharge direction is higher and on which the sheet-discharged by the upper sheet-discharge roller 120 is stacked. In this embodiment, a curved portion 136*a* is provided downstream in the sheet-discharge direction of the upper tray 136. The sheet-discharge apparatus 600 includes a sheet-discharge fan 702 that is an air blow unit for blowing air in the sheet-discharge direction from an air blow outlet 100*c* provided between the upper sheet-discharge roller 120 and the upper tray 136. When the sheet is discharged, air is blown by the sheet-discharge fan 702 toward a lower surface of the discharged sheet in a direction of a broken line in the drawing.

In FIGS. 3A and 3B, reference numeral 301 is a sheet sensor, and a finisher control portion described later lowers the upper tray 136 based on a signal from the sheet sensor 301 to maintain a constant height of a sheet surface of a stacked sheet on the upper tray 136. In this embodiment, the sheet sensor 301 is a transmission sensor that detects sheet ends in front and back directions in the drawing, and can detect presence or absence of a sheet by transmission and shielding of light from the sensor.

After the sheet is stacked, an upper tray motor 302 shown in FIG. 5 described later is driven to lower the upper tray 136. After the sheet sensor 301 detects a sheet end, the upper tray motor 302 is stopped and thus an uppermost sheet stops at a position of the sheet sensor 301. This can maintain a constant height of the sheet surface of the stacked sheet on the upper tray 136.

Figure 4:
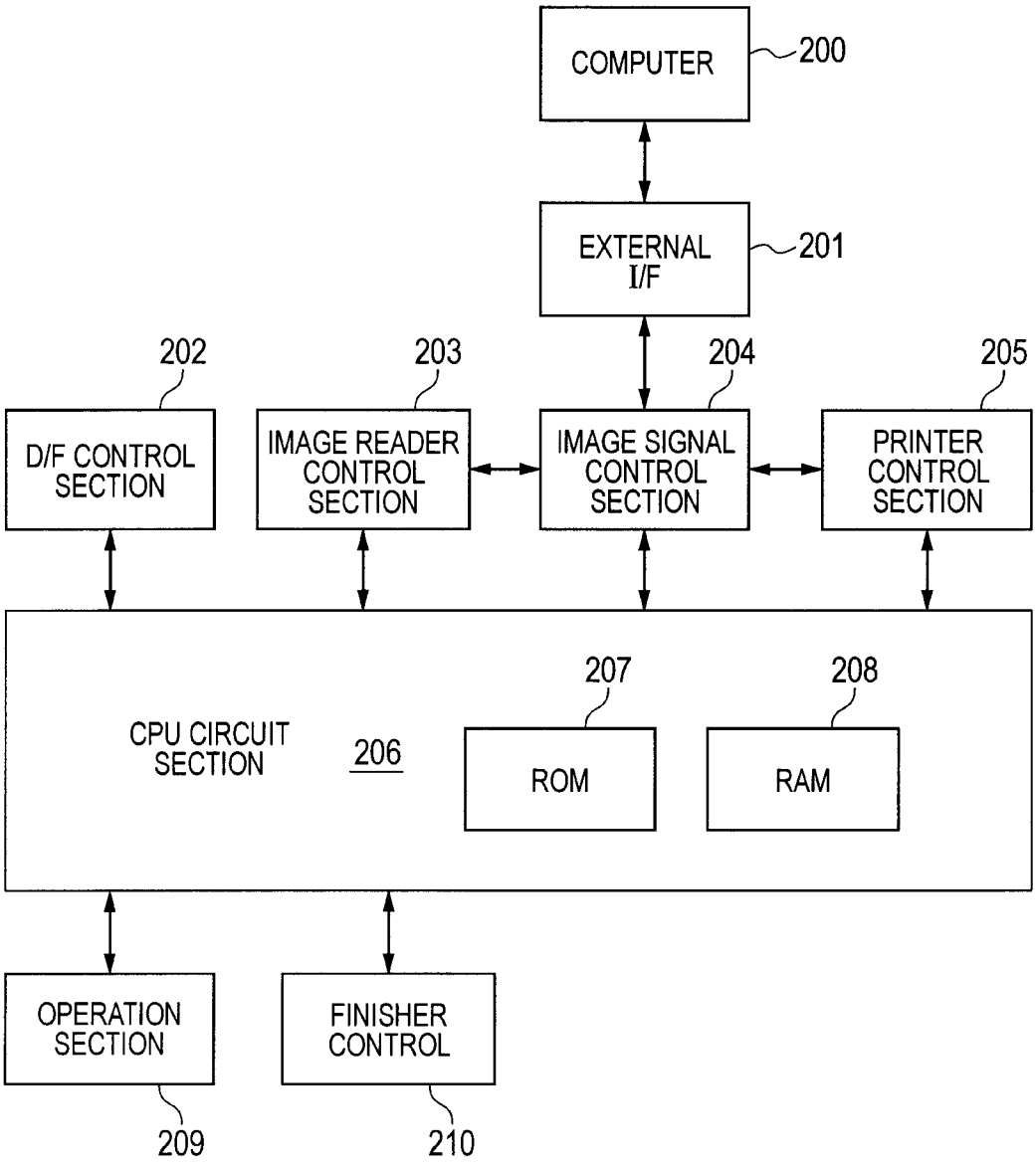
FIG. 4 is a control block diagram of the image forming apparatus.

FIG. 4 is a control block diagram of an image forming apparatus 900. As shown in FIG. 4, the CPU circuit portion 206 includes an unshown CPU, a ROM 207, and a RAM 208. The CPU circuit portion 206 controls a DF (document feeding apparatus) control portion 202, an image reader control portion 203, an image signal control portion 204, a printer control portion 205, a finisher control portion 210, and an external interface 201. The CPU circuit portion 206 performs control according to a program stored in the ROM 207 and setting of an operation portion 209.

The DF (document feeding apparatus) control portion 202 controls the document feeding apparatus 950, and the image reader control portion 203 controls an image reader. The printer control portion 205 controls the apparatus body 900A, and the finisher control portion 210 controls the finisher 100 (the sheet-discharge apparatus 600 therein). In this embodiment, a configuration will be described in which the finisher control portion 210 is mounted in the finisher 100. However, the present invention is not limited thereto, but the finisher control portion 210 may be provided in the apparatus body 900A integrally with the CPU circuit portion 206 so as to control the finisher 100 from the side of the apparatus body 900A.

The RAM 208 is used as an area for temporarily holding control data or a work area for calculation in control. An external interface 201 is an interface from a computer (PC) 200, and develops print data into an image and outputs the image to an image signal control portion 204. An image read by an image sensor is output from the image reader control portion 203 to the image signal control portion 204, and an image output from the image signal control portion 204 to the printer control portion 205 is input to an exposure control portion.

The finisher control portion 210 is mounted in the finisher 100 and transmits and receives information to and from the CPU circuit portion 206 to control driving of the entire finisher. The finisher control portion 210 that controls driving of the finisher 100 includes, as shown in FIG. 5, a CPU 850, a ROM 851, a RAM 852, or the like. The finisher control portion 210 communicates with the CPU circuit portion 206 via a communication IC 854 to exchange data, and executes various programs stored in the ROM 851 based on an instruction from the CPU circuit portion 206 to control driving of the finisher 100.

In control driving of the finisher, the finisher control portion 210 takes in detection signals from various sensors. The various sensors include the above-described inlet sensor 101 shown in FIG. 2, the lateral direction registration detection sensor 104, timing sensors 106, 109, 119, 123 and 127 that detect a sheet and are used to control conveyance, and the sheet sensor 301. A driver 853 is connected to the finisher control portion 210, and drives the first solenoid 701*a*, the second solenoid 701*b*, the sheet-discharge fan 702, the upper tray motor 302, or the like based on signals from the finisher control portion 210.

In this embodiment, when the sheet is stacked on the upper tray 136, a velocity of air (hereinafter referred to as an air velocity) blown from the sheet-discharge fan 702 depending on a basis weight that is a mass per unit area (1 $m^2$) of the sheet P is changed. Specifically, when the basis weight of the discharged sheet is a predetermined value Ts or less, that is, when the stiffness of the sheet is a predetermined value or less, the air velocity is increased with increasing basis weight. When the basis weight of the discharged sheet exceeds a predetermined value, that is, when the stiffness of the sheet exceeds a predetermined level, the air velocity of the sheet-discharge fan 702 becomes a minimum air velocity of the air blown for the sheet discharge. The minimum air velocity is set to an air velocity at which air blown from the sheet-discharge fan 702 does not press and move the sheet after the discharged sheet is stacked. The air velocity of air blown from the sheet-discharge fan 702 increases with increasing rotation rate of the sheet-discharge fan 702, and an amount of air also increases in proportional to the air velocity.

Figure 6:
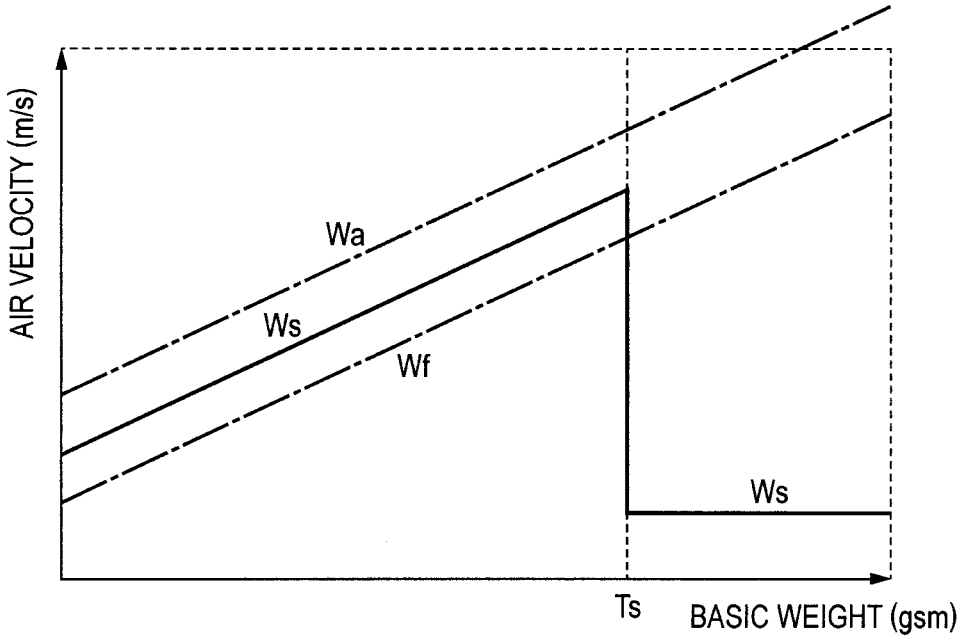
FIG. 6 illustrates a relationship between an air velocity of a sheet-discharge fan of the sheet-discharge apparatus and a basis weight of a discharged sheet.

FIG. 6 illustrates a relationship between the air velocity of the sheet-discharge fan 702 and the basis weight of the discharged sheet P. As shown in FIG. 6, as the basis weight of the sheet increases, an air velocity Ws required for raising the sheet increases, and thus the basis weight of the sheet P is proportional to the air velocity. The air velocity Ws of the sheet-discharge fan 702 is set between an air velocity Wf at least necessary for raising the sheet P and an air velocity Wa at which a position of the discharged sheet P is significantly disturbed and flutters, and thus the sheet P can be stably raised in discharge.

On the other hand, when the basis weight of the discharged sheet P exceeds the predetermined value Ts, the set air velocity Ws is set to the minimum air velocity lower than the air velocity Wf at which the sheet P having a minimum basis weight is raised. When the basis weight of the sheet to be discharged exceeds a predetermined value, it is not necessary to prevent the leading edge of the sheet from hanging down by blowing air. So control may be performed as to stop the sheet-discharge fan 702. However, because it takes time to return from stopped state of the sheet-discharge fan 702 to the air velocity at which the sheet P is raised when the basis weight of the next sheet is the predetermined value Ts or less, the air velocity Ws is set to the minimum air velocity which does not affect the sheet discharge. The predetermined value Ts of the basis weight refers to a basis weight of a threshold with such stiffness that after the sheet P is discharged, the sheet P does not fit the curved portion 136*a* of the upper tray 136 by gravity.

As such, in this embodiment, when the basis weight of the discharged sheet is the predetermined value Ts or less, the air velocity is increased with increasing basis weight, and when the basis weight of the discharged sheet exceeds the predetermined value, the air velocity is set to an air velocity at which the discharged sheet is not moved in the sheet-discharge direction.

Next, a sheet-discharge operation of the sheet-discharge apparatus 600 having such a configuration will be described. First, an operation of discharging the sheet P with the basis weight of the predetermined value Ts or less will be described. For the sheet with the basis weight of the predetermined value Ts or less, when the sheet is discharged to the upper tray 136 by the upper sheet-discharge roller 120, as shown in FIG. 3A, the sheet-discharge fan 702 blows air at an air velocity depending on the basis weight of the sheet P.

When the sheet is discharged from the upper sheet-discharge roller 120 in such a state where the sheet-discharge fan 702 blows air, as shown in FIG. 3B, air from the sheet-discharge fan 702 is blown on a lower surface of the discharged sheet P. Thus, the sheet P is raised by t from a sheet already stacked on the upper tray 136 (hereinafter referred to as a stacked sheet) P', and discharged from the sheet-discharge outlet 100*b* without being brought into contact with the stacked sheet P'.

Figure 7A:
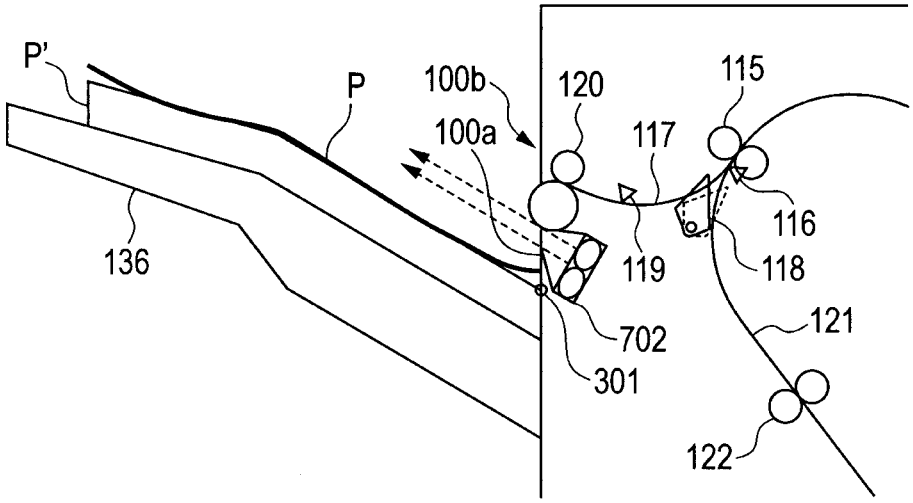
FIGS. 7A and 7B illustrate a second state of the sheet in the sheet-discharge operation of the sheet-discharge apparatus.

Next, when the sheet P is completely discharged from the upper sheet-discharge roller 120, as shown in FIG. 7A, the sheet P falls as it is onto the stacked sheet P'. At this time, because of the low stiffness of the sheet P, the sheet P fits a shape of the curved portion 136*a* of the upper tray 136 or the stacked sheet P', and is then returned by inclination of the upper tray 136 to a stack wall 100*a* constituted by a side end of the finisher 100, and thus stacking is completed. After the discharge, by the inclination of the upper tray 136, the upstream edge of the sheet is brought into contact with the stack wall 100*a* that is provided upstream in the sheet-discharge direction of the upper tray 136 and is a contact portion brought into contact with the upstream edge in the sheet-discharge direction of the sheet P to regulate an upstream edge position of the sheet.

Figure 7B:
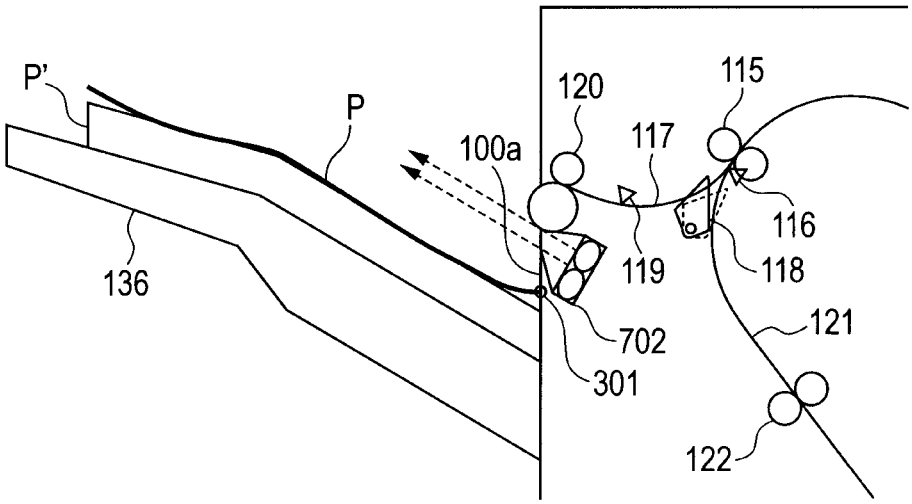

Next, the finisher control portion 210 performs sheet surface control of the upper tray 136. Specifically, the upper tray motor 302 lowers the upper tray 136, and as shown in FIG. 7B, driving of the upper tray motor 302 is stopped at the time when the upstream edge of the sheet P reaches the sheet sensor 301. Thus, the operation of the sheet surface control is completed. When sheets P are continuously discharged and stacked, successive sheets are repeatedly discharged and stacked by the above-described method while the sheet surface control is performed.

Next, an operation of discharging the sheet P exceeding the basis weight of the predetermined value Ts will be described. When the basis weight exceeds the predetermined value Ts, as shown in FIG. 3A described above, the sheet-discharge fan 702 blows air at an air velocity depending on the basis weight of the sheet P in discharge of the sheet to the upper tray 136. At this time, the basis weight of the sheet P exceeds the predetermined value Ts, and thus the air velocity of the sheet-discharge fan 702 is set lower than the air velocity Wf or less at which the sheet P having a minimum basis weight is raised as shown in FIG. 6 described above.

Figure 8A:
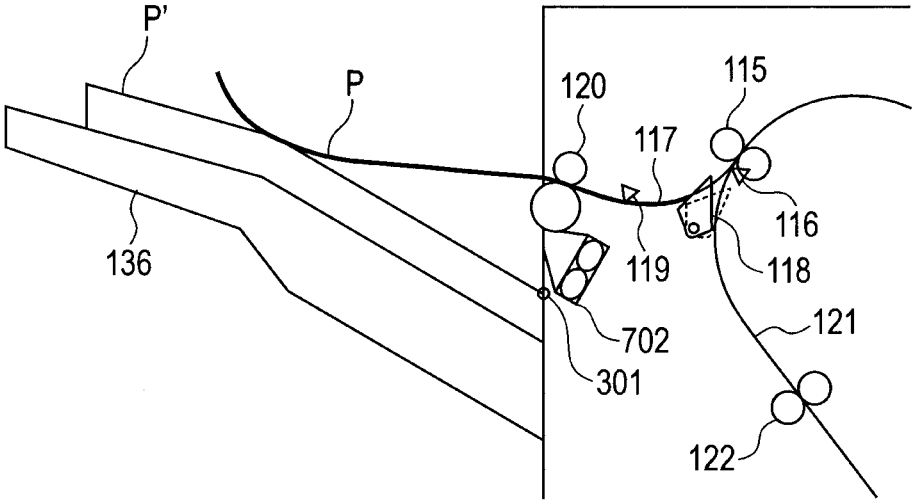
FIGS. 8A and 8B illustrate a third state of the sheet in the sheet-discharge operation of the sheet-discharge apparatus.

For the sheet P exceeding the basis weight of the predetermined value Ts, front edge and trailing edge (upstream edge) may be curled upward. When the sheet P is thus curled, or the air velocity is set to the air velocity Wf or less, as shown in FIG. 8A, the leading edge of the sheet P discharged by the upper sheet-discharge roller 120 is first brought into contact with the stacked sheet P' (upper tray 136).

Figure 8B:
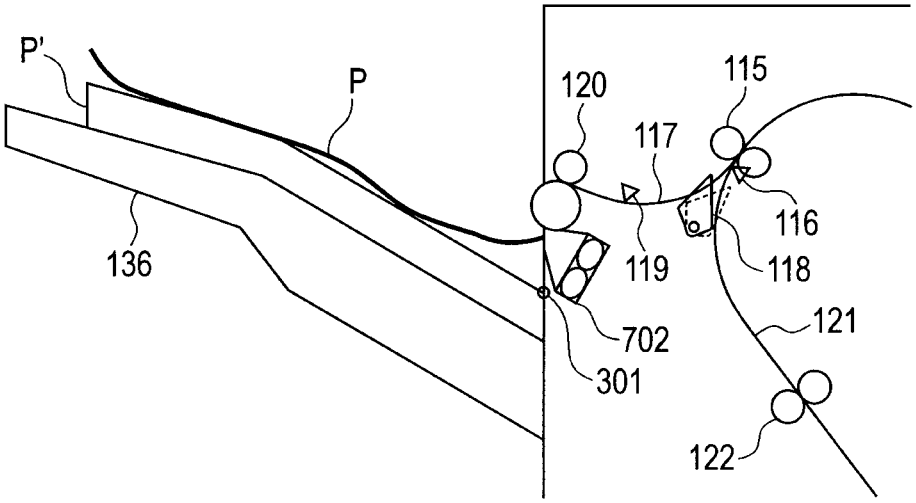

At this time, because of the high stiffness, the leading edge of the sheet P does not fit the shape of the stacked sheet P' (upper tray 136), and the sheet P is discharged with a part thereof in point contact with the stacked sheet P'. After the discharge is completed, the sheet P is stacked on the upper tray 136 so that the trailing edge (upstream edge) of the sheet P covers the sheet-discharge fan 702 as shown in FIG. 8B. At this time, because of the low air velocity of the sheet-discharge fan 702, the sheet P is not affected by air blown from the sheet-discharge fan 702, that is, the sheet P is not moved in the sheet-discharge direction or not raised to close the sheet-discharge outlet 100*b*, and the stacking is completed.

Figure 9:
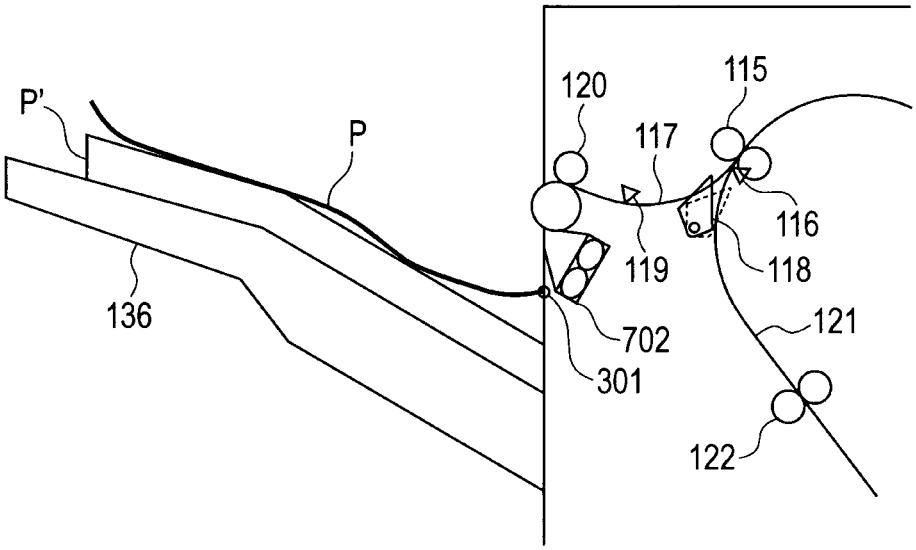
FIG. 9 illustrates a fourth state of the sheet in the sheet-discharge operation of the sheet-discharge apparatus.

Next, as shown in FIG. 9, the finisher control portion 210 performs the sheet surface control of the upper tray 136. Specifically, the upper tray motor 302 lowers the upper tray 136, and at the time when the trailing edge (upstream edge) of the sheet P reaches the sheet sensor 301, driving of the upper tray motor 302 is stopped to complete the operation of the sheet surface control. When the sheets P are continuously discharged and stacked, successive sheets are repeatedly discharged and stacked by the above described method while the sheet surface control is performed.

As such, when the sheet P with high stiffness is discharged, the air velocity of the sheet-discharge fan 702 is reduced. Thus, even if the sheet P is discharged and stacked without fitting the stacked sheet P', the air blown from the sheet-discharge fan 702 does not move the sheet P. This can prevent a reduction in sheet alignment properties on the stacking tray. This also prevents the air blown from the sheet-discharge fan 702 from raising the sheet to close the sheet-discharge outlet 100*b*, thereby allowing the next sheet to be reliably discharged.

Figure 10:
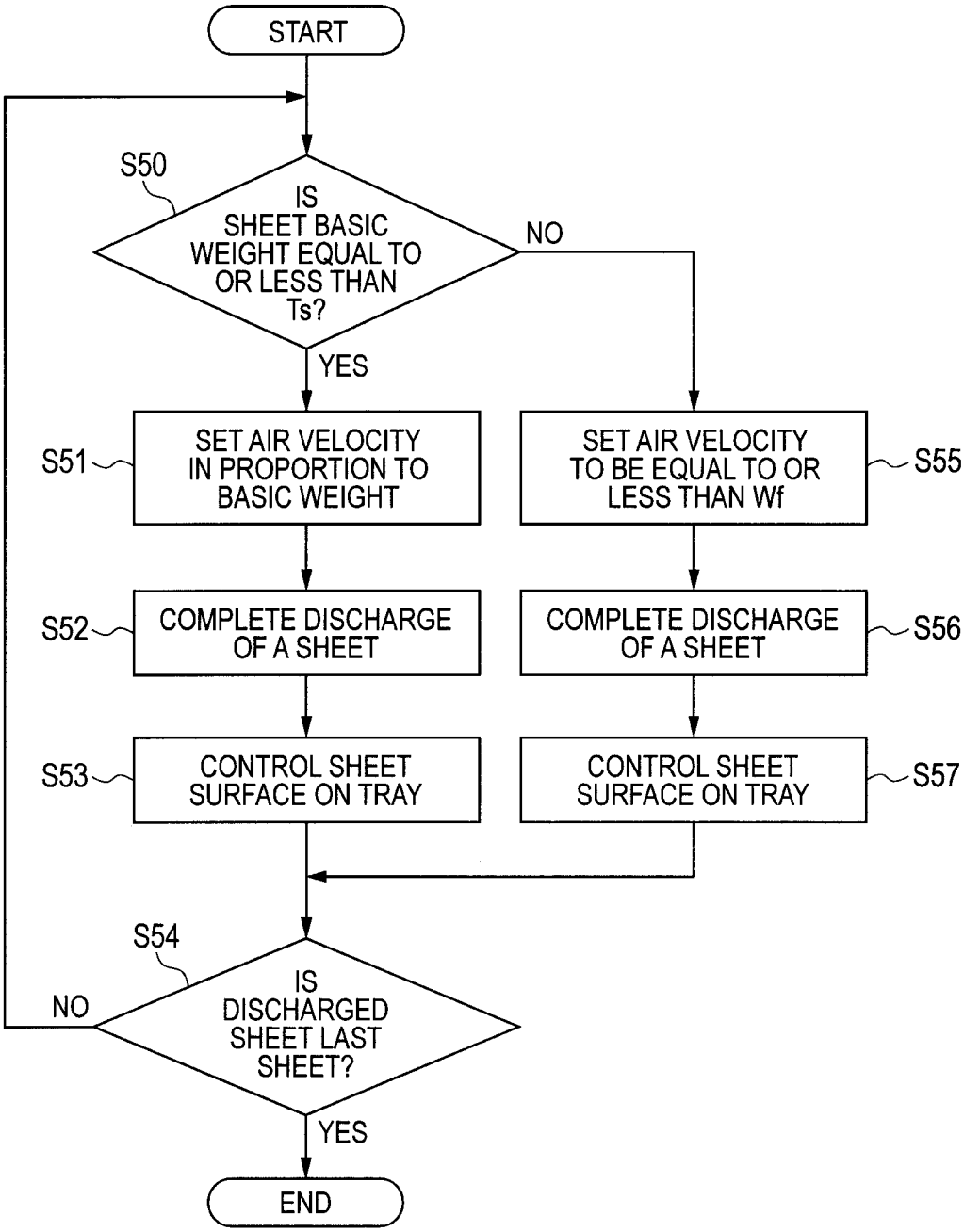
FIG. 10 is a flowchart illustrating air velocity control of the sheet-discharge fan.
Figure 11:
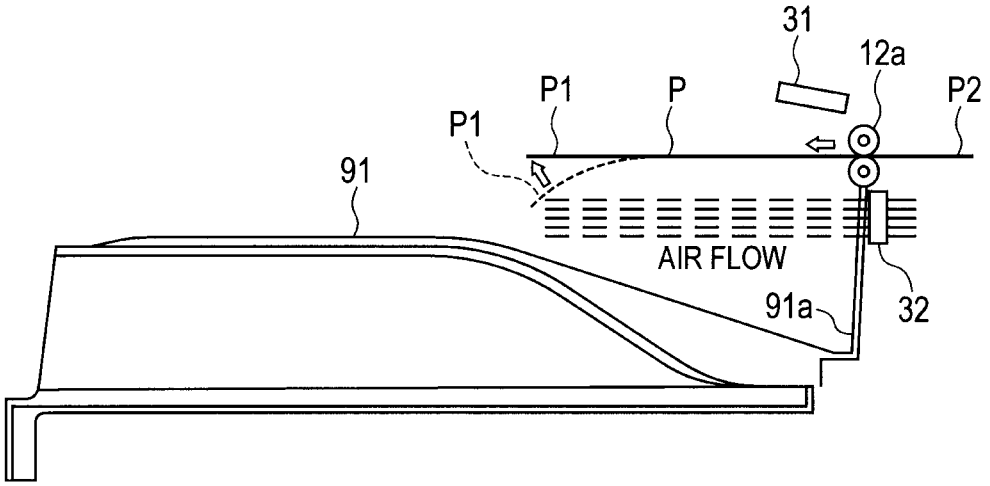
FIG. 11 illustrates a sheet-discharge operation of a conventional sheet-discharge apparatus.

Next, the air velocity control of the sheet-discharge fan 702 depending on the basis weight of the sheet-discharge apparatus 600 will be described with reference to a flowchart shown in FIG. 10. First, when stacking of the sheet on the upper tray 136 is started, it is determined whether the basis weight of the sheet is higher or lower than the predetermined value Ts, that is, whether the basis weight of the sheet is the predetermined value Ts or less (S50). Basis weight information as stiffness information is input to the printer control portion 205 in the image forming apparatus 900 by the operation portion 209 as an input portion, and transmitted to the finisher control portion 210 by the printer control portion 205.

In this embodiment, the air velocity control of the sheet-discharge fan 702 performed based on the basis weight information input from the operation portion 209 will be described. A thickness detection portion that detects a thickness of the sheet may be provided in a conveying path, and thickness information of the conveyed sheet may be used as basis weight information.

When the basis weight is Ts or less (Y in S50), the air velocity of the sheet-discharge fan is set so as to increase in proportional to the basis weight (S51). The air velocity of the sheet-discharge fan desirably reaches the set air velocity Ws before the discharged sheet is brought into contact with the stacked sheet, but may be at least the raising air velocity Wf or more. Then, discharge of the sheet is completed (S52), the upper tray is then lowered to perform the sheet surface control of the upper tray (S53), and discharge of one sheet is completed. Next, it is determined whether the discharged sheet is the last sheet (S54). When the sheet is the last sheet (Y in S54), stacking control is completed, and when the sheet is not the last sheet (N in S54), the processes in S50 to S53 are repeated.

On the other hand, when the basis weight exceeds Ts (N in S50), the air velocity is set to Wf or less (S55). The air velocity in this case desirably reaches the set air velocity before the discharge of the sheet onto the stacking tray is completed, but may be at least the raising air velocity Wf or less. Then, the discharge of the sheet is completed (S56), the upper tray is then raised or lowered to perform the sheet surface control of the upper tray (S57), and discharge of one sheet is completed. Next, it is determined whether the discharged sheet is the last sheet (S54). When the sheet is the last sheet (Y in S54), stacking control is completed, and when the sheet is not the last sheet (N in S54), the processes in S55 to S57 are repeated.

When the basis weight of the sheet is the predetermined value or less, the air velocity of the sheet-discharge fan 702 can be increased depending on the basis weight of the sheet to prevent a reduction in sheet alignment properties. When the basis weight of the sheet exceeds the predetermined value, the air velocity can be set to the air velocity or less at which the discharged sheet is raised from the stacked sheet, thereby preventing disturbing sheet alignment properties. Further, the sheet is not raised to close the sheet-discharge outlet 100*b*, and thus the next sheet can be reliably discharged.

Specifically, as in this embodiment, the air velocity of the sheet-discharge fan 702 is controlled depending on the basis weight (stiffness) of the sheet, thereby preventing a reduction in sheet alignment properties without reducing productivity. When the basis weight exceeds Ts, it goes without saying that the same advantage can be obtained by setting the minimum air velocity Wf or less of the sheet-discharge fan 702 to 0, that is, the air velocity at which no air blows.

In this embodiment, the case where the sheet-discharge apparatus according to the present invention is provided in the finisher is described. However, the same advantage can be obtained even when the sheet-discharge apparatus according to the present invention is integrally provided with the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-231499, filed Oct. 14, 2010, and 2011-210275, filed Sep. 27, 2011, which are hereby incorporated by reference herein in their entirety.

What is claimed is:

1. A sheet-discharge apparatus comprising:

a sheet-discharge portion that discharges a sheet;

a sheet-stacking portion on which sheets discharged by the sheet-discharge portion are stacked, the sheet-stacking portion inclined so that a downstream side in a sheet discharge direction is higher;

a contact portion provided upstream in the sheet-discharge direction of the sheet-stacking portion, and with which an upstream edge of the discharged sheet in the sheet discharge direction is brought into contact by an inclination of the sheet-stacking portion to regulate a position of the upstream edges in the sheet discharge direction;

an air blow unit that blows air against an undersurface of the sheet discharged by the sheet-discharge portion from an air blow outlet provided between the sheet-discharge portion and the sheet-stacking portion; and a control portion configured to control an air velocity of air blown from the air blow unit, wherein in a case where the control portion obtains information in which a basis weight of the sheet is a predetermined value, the control portion sets the air blow velocity of the air blow unit at a first air blow velocity, and in a case where the control portion obtains information in which the basis weight of the sheet is less than the predetermined value, the control portion sets the air blow velocity of the air blow unit at a second air blow velocity less than the first air blow velocity, and in a case where the control portion obtains information in which the basis weight of the sheet exceeds the redetermined value, the control portion sets the air blow velocity of the air blow unit at a third air blow velocity less than the first air blow velocity.

2. A sheet-discharge apparatus according to claim 1, wherein in a case where the control portion obtains information in which the basis weight exceeds the predetermined value, the control portion sets the air blow velocity of air blown from the air blow unit at zero.

3. A sheet-discharge apparatus according to claim 1, wherein the sheet-stacking portion has a shape that starts curving from a curved portion provided on a downstream side in the sheet discharge direction of the sheet-stacking portion, wherein the predetermined value of the basis weight of the sheet is a basis weight at which the sheet discharged onto the sheet-stacking portion does not fit the shape of the curved portion of the sheet-stacking portion.

4. A sheet-discharge apparatus according to claim 1, further comprising an input portion for allowing a user to input information corresponding to a basis weight of the sheet, wherein the control portion obtains the information corresponding to the basis weight of the sheet input by the input portion.

5. A sheet-discharge apparatus according to claim 1, further comprising a detection portion that detects the information corresponding to the basis weight information of the sheet, wherein the control portion obtains the information corresponding to the basis weight of the sheet detected by the detection portion.

6. A sheet-discharge apparatus according to claim 1, wherein in the case where the control portion obtains information in which the basis weight of the sheet is equal to or less than the predetermined value, the larger the basis weight is, the more the control portion increases the air blow velocity of the air blow unit.

7. A sheet-discharge apparatus according to claim 1, wherein the control portion sets the third air blow velocity as a minimum air blow velocity from among air blow velocities at which the air blow unit blows air against the undersurface of the discharged sheet.

8. A sheet processing apparatus comprising:

a processing portion that processes a sheet;

a sheet-discharge portion that discharges the sheet processed by the processing portion;

a sheet-stacking portion on which stacks sheets discharged by the sheet-discharge portion, the sheet-stacking portion inclined so that a downstream side in a sheet discharge direction is higher;

a contact portion provided upstream in the sheet discharge direction of the sheet-stacking portion, and with which an upstream edge of the discharged sheet in the sheet discharge direction is brought into contact by an inclination of the sheet-stacking portion to regulate a position of the upstream edges in the sheet discharge direction;

an air blow unit that blows air against an undersurface of the sheet discharged by the sheet-discharge portion from an air blow outlet provided between the sheet-discharge portion and the sheet-stacking portion;

a control portion configured to control an air velocity of air blown from the air blow unit, wherein in a case where the control portion obtains information in which a basis weight of the sheet is a predetermined value, the control portion sets an air blow velocity of the air blow unit at a first air blow velocity, and in a case where the control portion obtains information in which the basis weight of the sheet is less than the predetermined value, the control portion sets the air blow velocity of the air blow unit at a second air blow velocity less than the first air blow velocity, and in a case where the control portion obtains information in which the basis weight of the sheet exceeds the predetermined value, the control portion sets the air blow velocity of the air blow unit at a third air blow velocity less than the first air blow velocity.

9. A sheet processing apparatus according to claim 8, wherein in a case where the control portion obtains information in which the basis weight of the sheet exceeds the predetermined value, the control portion sets the air blow velocity of air blown from the air blow unit at zero.

10. A sheet processing apparatus according to claim 8, wherein the sheet-stacking portion has a shape that starts curving from a curved portion provided on a downstream side in the sheet discharge direction of the sheet-stacking portion, wherein the predetermined value of the basis weight of the sheet is a basis weight at which the sheet discharged onto the sheet-stacking portion does not fit the shape of the curved portion of the sheet-stacking portion.

11. A sheet processing apparatus according to claim 8, further comprising an input portion for allowing a user to input information corresponding to a basis weight of the sheet on which the image is formed, wherein the control portion obtains the information corresponding to the basis weight of the sheet from the input portion.

12. A sheet processing apparatus according to claim 8, further comprising a detection portion that detects the information corresponding to the basis weight information of the sheet, wherein the control portion obtains the information corresponding to the basis weight of the sheet detected by the detection portion.

13. A sheet processing apparatus according to claim 8, wherein in the case where the control portion obtains information in which the basis weight of the sheet is equal to or less than the predetermined value is obtained by the control portion, the larger the basis weight is, the more the control portion increases the air blow velocity of the air blow unit.

14. A sheet processing apparatus according to claim 8, wherein the control portion sets the third air blow velocity as a minimum air blow velocity from among air blow velocities at which the air blow unit blows air against an undersurface of the discharged sheet.

15. An image forming apparatus comprising:

an image forming portion that forms an image on a sheet;

a sheet-discharge portion that discharges a sheet;

a sheet-stacking portion on which sheets discharged by the sheet-discharge portion are stacked, the sheet-stacking portion inclined so that a downstream side in a sheet discharge direction is higher;

a contact portion provided upstream in the sheet discharge direction of the sheet-stacking portion, and with which an upstream edge of the discharged sheet in the sheet discharge direction is brought into contact by an inclination of the sheet-stacking portion to regulate a position of the upstream edges in the sheet discharge direction;

an air blow unit that blows air against an undersurface of the sheet discharged by the sheet-discharge portion from an air blow outlet provided between the sheet-discharge portion and the sheet-stacking portion;

an input portion for allowing a user to input information corresponding to a basis weight of the sheet on which the image is formed;

a control portion configured to control an air velocity of air blown from the air blow unit, wherein in a case where the control portion obtains information in which a basis weight of the sheet is a predetermined value, the control portion sets an air blow velocity of the air blow unit at a first air blow velocity, and in a case where the control portion obtains information in which the basis weight of the sheet is less than the predetermined value, the control portion sets the air blow velocity of the air blow unit at a second air blow velocity less than the first air blow velocity, and in a case where the control portion obtains information in which the basis weight of the sheet exceeds the redetermined value the control portion sets the air blow velocity of the air blow unit at a third air blow velocity less than the first air blow velocity.

16. An image forming apparatus according to claim 15, wherein in a case where the control portion obtains information in which the basis weight of the sheet exceeds the predetermined value, the control portion sets the air blow velocity of air blown from the air blow unit at zero.

17. An image forming apparatus according to claim 15, wherein the sheet-stacking portion has a shape that starts curving from a curved portion provided on a downstream side in the sheet discharge direction of the sheet-stacking portion, wherein the predetermined value of the basis weight of the sheet is a basis weight at which the sheet discharged onto the sheet-stacking portion does not fit the shape of the curved portion of the sheet-stacking portion.

18. An image forming apparatus according to claim 15, wherein in the case where the control portion obtains information in which the basis weight is equal to or less than a predetermined value, the larger the basis weight, the more the control portion increases the air blow velocity of the air blow unit.

19. An image forming apparatus according to claim 15, wherein the control portion sets the third air blow velocity as a minimum air blow velocity from among air blow velocities at which the air blow unit blows air against an undersurface of the discharged sheet.

20. A sheet-discharge apparatus comprising:

a sheet-discharge portion that discharges a sheet;

a sheet-stacking portion on which sheets discharged by the sheet-discharge portion are stacked, the sheet-stacking portion inclined so that a downstream side in a sheet discharge direction is higher;

a contact portion provided upstream in the sheet-discharge direction of the sheet-stacking portion, and with which an upstream edge of the discharged sheet in the sheet discharge direction is brought into contact;

an air blow unit that blows air against an undersurface of the sheet discharged by the sheet-discharge portion to the sheet-stacking portion; and a control portion configured to control an air volume of air blown from the air blow unit, wherein in a case where the control portion obtains information in which a basis weight of the sheet is a predetermined value, the control portion sets the air blow volume of the air blow unit at a first air blow volume, and in a case where the control portion obtains information in which the basis weight of the sheet is less than the predetermined value, the control portion sets the air blow volume of the air blow unit at a second air blow volume less than the first air blow volume, and in a case where the control portion obtains information in which the basis weight of the sheet exceeds the predetermined value, the control portion sets the air blow volume of the air blow unit at a third air blow volume less than the first air blow volume.

21. A sheet-discharge apparatus according to claim 20, wherein the air blow unit includes a fan and the control unit configured to control a rotation speed of the fan.

* * * * *